United States Patent [19]

Nagatani

[11] 4,376,412

[45] Mar. 15, 1983

[54] SQUEEGEE PRESSING DEVICE IN A SCREEN PRINTING MACHINE

[75] Inventor: Kazuo Nagatani, Seki, Japan

[73] Assignee: Sakurai Machine Trading Co., Ltd., Tokyo, Japan

[21] Appl. No.: 329,173

[22] Filed: Dec. 10, 1981

[30] Foreign Application Priority Data

Jun. 4, 1981 [JP] Japan ..... 56-086057

[51] Int. Cl.[3] ..... B41L 27/36; B41L 13/02

[52] U.S. Cl. ..... 101/124; 101/126

[58] Field of Search ..... 101/116–120, 101/123, 124, 126

[56] References Cited

U.S. PATENT DOCUMENTS

| | | | |
|---|---|---|---|
| B 395,554 | 3/1976 | Zimmer | 101/116 |
| 2,017,706 | 10/1935 | Whedwright | 101/126 |
| 2,105,572 | 1/1938 | Williams | 101/124 |
| 2,369,290 | 2/1945 | Foard | 101/126 |
| 3,885,493 | 5/1975 | Jaffa | 101/123 |

*Primary Examiner*—Clyde I. Coughenour

*Attorney, Agent, or Firm*—Leydig, Voit, Osann, Mayer & Holt, Ltd.

[57] ABSTRACT

A device for pressing a squeegee for printing used in a screen printing machine. A screen plate is reciprocated and printing paper sheets are fed to the lower surface zone of the screen plate in timing with forward movement of the screen plate. A differential gearing is operatively associated with a cam driven from a drive source for the printing machine, and a link mechanism actuated by said cam, so that the squeegee is lowered by operation of the differential gearing and the screen plate is pressed by said squeegee for printing. In case of dismounting the screen frame from the machine frame for cleaning the screen plate, the casing for the differential gearing is rotated by drive means for raising the squeegee a larger distance stroke. The link mechanism is not driven into operation when the casing for the differential gearing is rotated during such upward travel of the squeegee.

6 Claims, 5 Drawing Figures

SQUEEGEE PRESSING DEVICE IN A SCREEN PRINTING MACHINE

FIELD OF THE INVENTION

This invention relates to a device for applying a printing pressure to a squeegee in a screen printing machine in which a screen plate is engaged in to and fro movement and printing paper sheets are supplied to the lower surface zone of the screen plate in timing with forward travel of the screen plate and in which the screen plate is pressed by a squeegee for printing the paper sheets through the screen when the squeegee vertically movable within a predetermined stroke distance is at the lowermost position thereof.

BACKGROUND OF THE INVENTION

Referring to FIGS. 1 through 3 for illustrating the conventional cylinder type screen printing machine, a cylinder driving gear 2 is carried on a support shaft of a suction cylinder 1, said driving gear 2 meshing with an oscillably mounted sector gear 3. The sector gear 3 may be swung reciprocably by rotation of a crank lever 5 through a crank rod 6 so that the suction cylinder 1 may be rotated in the fore and aft directions within a certain travel stroke. A pair of rack driving gears 7 are mounted on both end portions lengthwise of the suction cylinder 1.

A rack frame 10 is mounted movably in the fore and aft directions by slide bearings 9 at the four corners thereof for passage of a pair of slide guide shafts which in turn are mounted on the top of the suction cylinder 1. A pair of toothed racks 11 are mounted on both sides of the rack frame 10 for meshing with the rack driving gears 7. A screen plate 12 is mounted in a screen plate frame 13 which in turn is mounted in the rack frame 10. The rack frame 10 may be moved reciprocally in the fore and aft directions along the slide guide shaft 8 with forward and reverse rotations of the rack driving gears 7 caused by forward and reverse rotations of the suction cylinder 1.

Printing paper sheets P are fed one by one to a point A below the screen plate 12 by a paper sheet feed mechanism 14 and advanced therefrom to a point B along the outer peripheral surface of the suction cylinder 1, as they are gripped by a grip pawl 15 carried by the suction cylinder 1. The sheets P are held by suction on the suction cylinder 1 between said points A and B. The sheets P are released at point B by the grip pawl 15. At this time, the suction force so far holding the paper sheet P about the periphery of the cylinder 1 is also released, and the paper sheets P are discharged by a paper take-out device 16.

Printing takes place during the feed motion as described above. Thus, when the paper sheet P is gripped by the claw 15 and about to pass through an apex point C of the suction cylinder 1, a squeegee 17 mounted on top of the screen plate 12 is lowered for pressing the screen plate 12 for printing the sheet P passing therebelow, said screen plate being in its forward stroke timed with forward rotation of the suction cylinder 1. At this time, a doctor 18 mounted on the screen plate 12 in a side-by-side relation to the squeegee 17 is in its raised position.

After discharge of the printed sheet P, the suction cylinder 1 is rotated in the reverse direction and, in timing therewith, the screen plate 12 is moved rearward. At this time, the squeegee 17 is raised, while the doctor 18 is lowered for smoothing the ink applied to the printing plate 12.

As shown in FIG. 3, the squeegee 17 and the doctor 18 are mounted on one side of the screen plate 12 by way of a vertically movable squeegee post 20 and a vertically movable doctor post 21 the fore and aft end parts of a centrally fulcrumed lever 19 pivotally supported at its central portion. A cam disc 22 consisting of a portion **22*a* of a lesser radius of curvature and a portion 22*b* of a larger radius of curvature is mounted on the crank shaft 4. With rotation of the cam disc 22, the end parts of the lever 19 may be vertically reciprocally moved through a link mechanism consisting of a cam roller 24 on a cam lever 23, a connecting rod 25 and an intermediate lever 26, for alternately raising and lowering the posts 20, 21**.

On one side of and parallel to the squeegee post 20, a rack post 27 is mounted vertically movably and carries a toothed rack 28 at its lower end for meshing with a pinion 29. A speed reducing unit 30 connected to a reversible electric motor is connected via a chain 31 to the pinion 29 for vertically reciprocating the rack post 27. A tension spring 32 is placed between the lower end of rack post 27 and the upper portion of the squeegee post 20 for normally biasing the squeegee post 20 in a downward direction.

Thus, during printing, the squeegee 17 is pressed strongly onto screen plate 12 through the squeegee post 20 and by virtue of resiliency of the tension spring 32.

When the lesser radius of curvature portion **22*a* of the cam disc 22 fronts to the cam roller 24, the squeegee post 20 is lowered under the urging force of spring 32 to lower the squeegee 17, whilst the doctor post 21 is raised to raise the doctor 18. The printing pressure exerted by the squeegee 17 is a function of the spring force of the tension spring 32**.

When the larger radius of curvature portion **22*b* of the cam disc 22 fronts to cam roller 24, the squeegee 17 is raised against the force of the spring 32, whilst the doctor 18** is lowered.

When the rack post 27 is raised by the operation of the speed reducing unit 30, the upper end of the rack post 27 abuts on an engaging member 33 secured to the upper portion of the squeegee post 20 for raising the post 20, the squeegee 17 being also raised slightly. With the squeegee thus raised, the screen plate frame 13 may be dismounted for cleaning the screen plate 12, or again mounted in position, as the occasion may demand.

With the conventional device described above, the squeegee post 20 is mounted to one end extremity of the lever 19, and hence the squeegee 17 cannot be raised well above the screen plate 12. Neither the length of the lever 19 nor the distance between the center of rotation of the lever 19 and the lower end of the squeegee post 20 may be in excess of a certain value in consideration of possible interference with other components of the printing machine and thus a certain limitation is necessarily placed on the upward stroke distance of the squeegee 17.

In addition, in the above conventional device, the pressure applied by the squeegee 17 on the screen plate 12 is a function of the spring force of the tension spring 32. Thus, at a higher printing speed, impacts caused by oscillation of the tension spring 32 affects the squeegee 17 especially at the start of pressing of the squeegee, that is, at the start of printing, thus producing undulating printing irregularities on the printing surface.

OBJECT OF THE INVENTION

It is therefore a main object of the present invention to provide a squeegee pressing device in a screen printing machine in which the squeegee may be raised to a position well above the screen plate for mounting or dismounting the screen plate as when cleaning the screen plate rack and such raising of the squeegee may be effected without displacing the cam or link means for vertically moving the squeegee.

It is another object of the present invention to provide a squeegee pressing device in a screen printing machine in which the doctor may be raised a larger distance when the squeegee is raised a larger distance.

It is a further object of the present invention to provide a squeegee pressing device in a screen printing machine in which a stable and strong squeegee pressure can be applied to the screen plate during printing and printing irregularities may be completely removed.

Other objects of the present invention will be apparent from the following description of the preferred embodiment of the invention and the appended claims. Numerous advantages not pointed out in the present specification will be obvious to those skilled in the art upon execution of the present invention.

DETAILED DESCRIPTION OF THE PREFERRED EMBODIMENT

Figure 1:
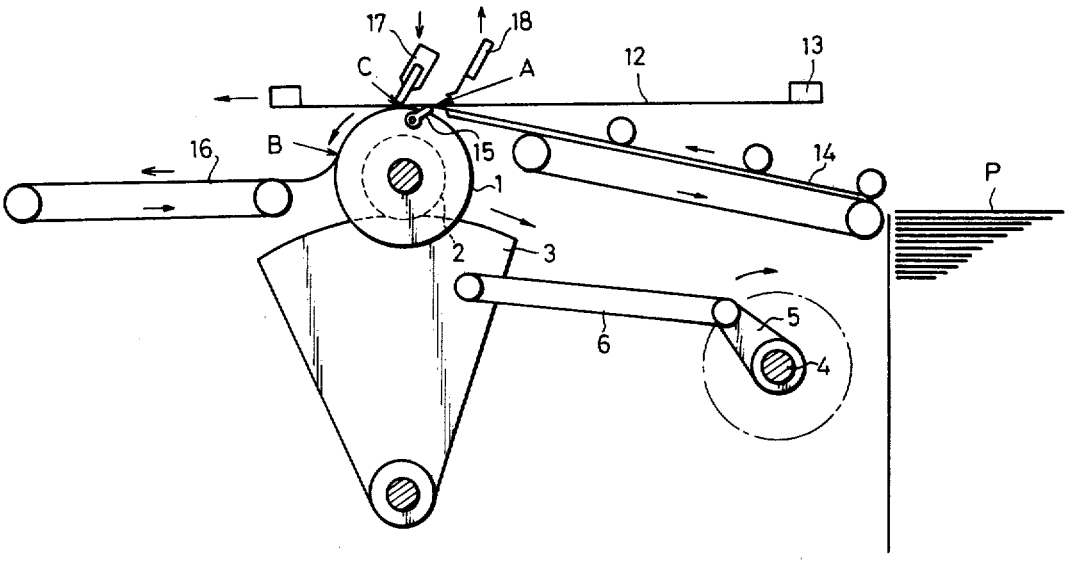
FIG. 1 (PRIOR ART)
FIG. 1 is a schematic outline view showing the cylinder type screen printing machine.
Figure 2:
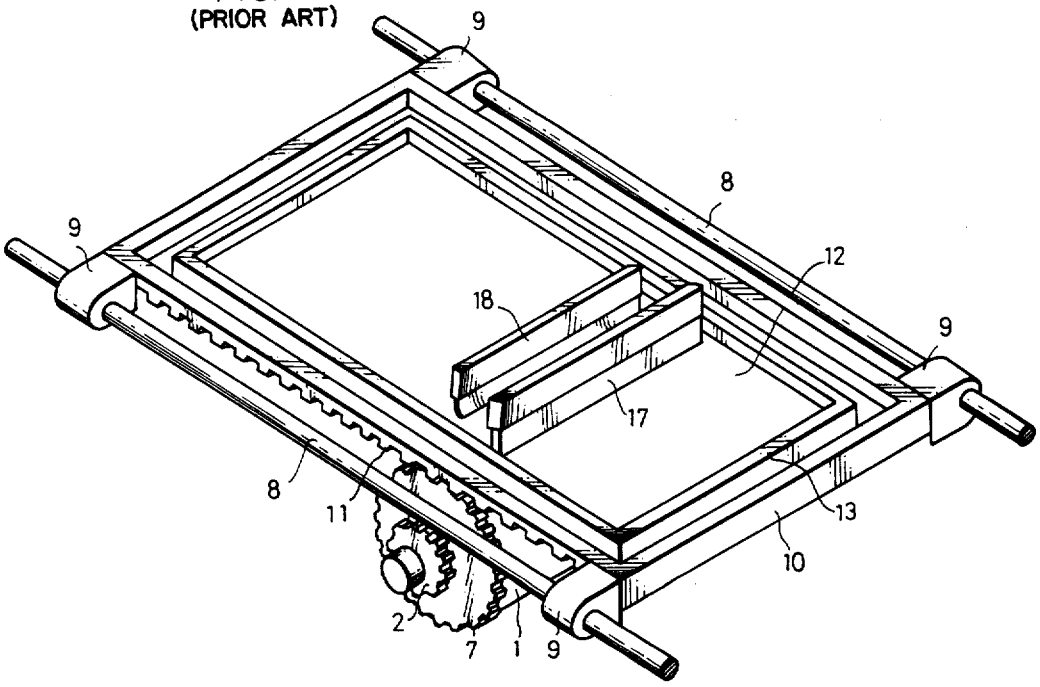
FIG. 2 (PRIOR ART)
FIG. 2 is a schematic perspective view showing the device for reciprocating the rack frame.
Figure 3:
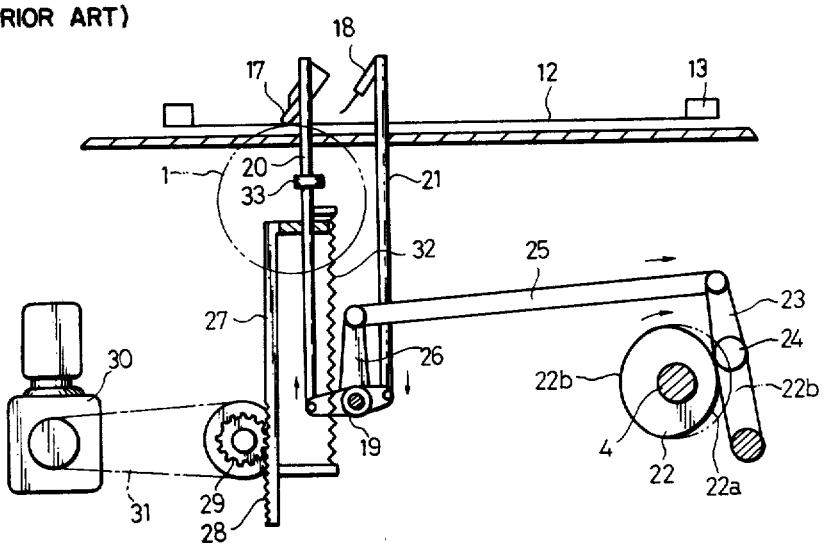
FIG. 3 (PRIOR ART)
FIG. 3 is a schematic outline view showing the conventional squeegee pressing device.
Figure 4:
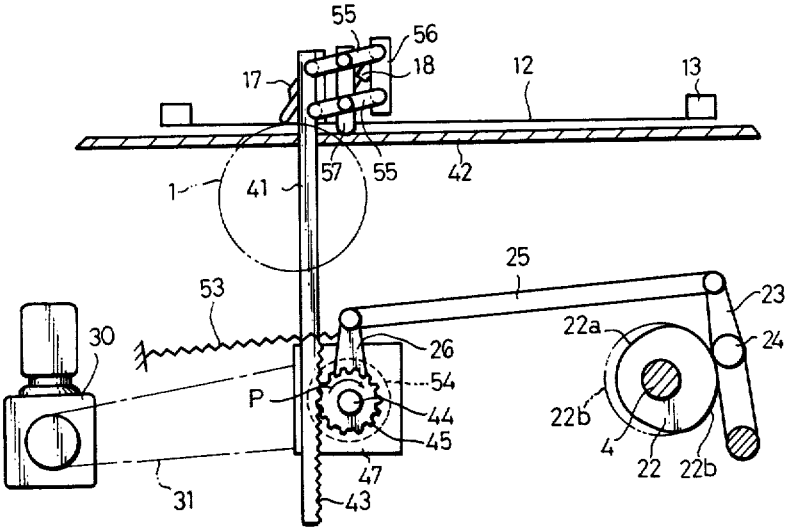
FIG. 4 is a schematic outline view showing the inventive squeegee pressing device.
Figure 5:
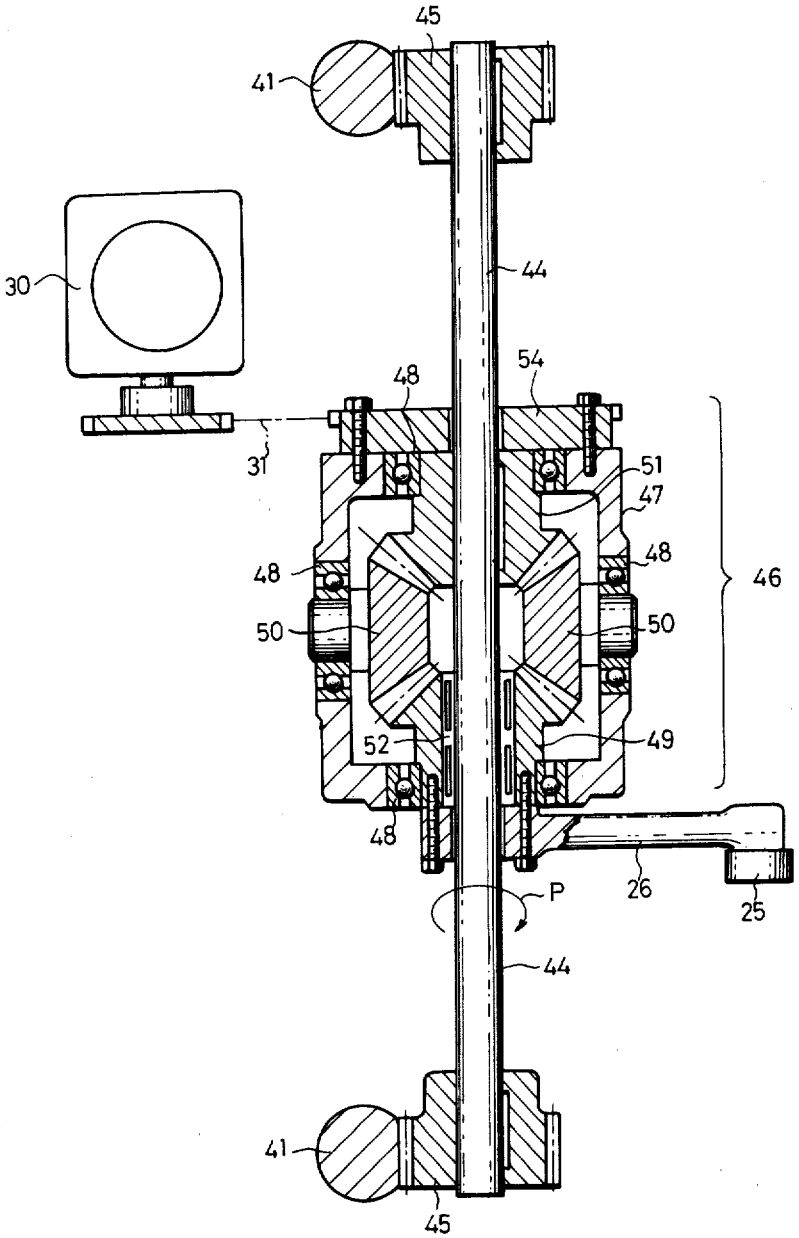
FIG. 5 is a sectional top plan view showing the differential gear unit employed in the inventive squeegee pressing device.

Reference is made to FIGS. 4 and 5 for illustrating a preferred embodiment of the present invention with special emphasis placed on the difference from the above conventional device. A squeegee 17 is mounted between upper end parts of a pair of squeegee posts 41 mounted on both sides of a rack frame 10 for vertical reciprocating motion relative to a machine frame 42. A toothed rack 43 is formed to the lower portion of each said posts 41 for meshing with a pinion 45 secured one each to both ends of a support shaft 44. A differential gearing unit 46 is mounted centrally to the support shaft 44.

The gearing unit 46 has a casing 47 as rotary member, a first bevel gear 49, a third bevel gear 51 and a pair of second bevel gears 50 mounted in an opposing relation by bearings 48 disposed on the four sides of the gearing unit, with the second bevel gears 50 meshing with the first and third bevel gears 49, 51. The shaft 44 is passed through first and third gears 49, 51 not meshing directly with each other. The shaft 44 is mounted loosely on the first bevel gear 49 by bearing 52 and made fast for rotation to the third gear 51. A lever 26 operatively linked with a cam disc 22 is secured to the first bevel gear 49 on shaft 44 and urged in a certain direction at all times by a tension spring 53. A sprocket 54 is secured to the casing 47 on the side of the third gear 51 and a chain 31 is placed between the sprocket 54 and the speed reducing unit 30.

To the upper end part of each squeegee post 41, a pair of doctor reciprocating levers 55 are pivotally mounted for extending towards aft. A pair of doctor mounting blocks 56 are pivotally mounted to the aft ends of the doctor reciprocating levers 55 for extending vertically. A pair of stopper pins 57, one on each side of the plate frame are pivotally mounted across the doctor reciprocating levers 55 between the doctor mounting blocks 56 and the upper ends of the squeegee post 41 for projecting down and abutting at the respective lower ends on the machine frame 42. A doctor 18 is mounted between the mounting blocks 56.

The upper and lower doctor reciprocating levers 55, the doctor mounting block 56 and the stopper pin 57 provide an interlock device for interlocking the vertical motion of the squeegee post 41 with vertical motion of the doctor 18.

The squeegee 17 and the doctor 18 may be moved vertically as follows.

When the larger radius of curvature portion **22*b* of the cam disc 22 fronts to the cam roller 24 with continued rotation of the crank shaft 4, the intermediate lever 26 of the link mechanism is tilted towards aft against the urging force of the tension spring 53 and the contact pressure of the squeegee 17 with the screen plate 12, so that the first bevel gear 49 is rotated a predetermined angle in the direction of the arrow mark P in FIG. 5. Such rotation of the gear 49 is transmitted via second bevel gears 50 to the third bevel gear 51 which is thus rotated in the reverse direction of arrow mark P, the shaft 44 and the pair of pinions 45 being thereby rotated in the same direction. The squeegee posts 41 on either sides of the screen plate are lowered with revolution of the pinions 45, the squeegee 17 thus pressing the screen plate 12**.

During such pressing, it is the cam disc 22 that actuates the link mechanism against the contact pressure between the screen plate 12 and the squeegee 17. Thus, the squeegee 17 is not subjected to the vertical oscillation acting on the screen plate 12 during start of printing when the squeegee 17 begins to press the screen plate 12 and hence there is no risk of occurrence of printing irregularities.

When the squeegee posts 41 lowers in this way, and the stopper pins 57 are engaged on the upper surface of the machine frame 42, the levers 55 are swung upwards at the aft portions thereof for raising the doctor mounting blocks 56 and the doctor 18.

When the lesser radius of the curvature portion **22*a* of the cam disc 22 fronts to cam roller 24, the lever 26 is tilted forwardly under the force of the tension spring 53. Thus the first bevel gear 49 is rotated a predetermined angle in the direction opposite to the arrow mark direction P, for rotating the shaft 44 and the pinions 45 in the same direction through gears 50, 51, and raising the squeegee posts 41 along with the squeegee 17. When the posts 41 are raised in this way, the doctor mounting blocks 58 are lowered by their gravity about the lower end portions of the stopper pins 57 as center, so that the doctor 18** is also lowered.

The squeegee 17 and the doctor 18 are alternately raised and lowered in this way with rotation of the cam 22.

When it is desired to raise the squeegee 17 and the doctor 18 simultaneously by 10 to 20 cm for mounting or detaching the screen plate frame 13 for cleaning the screen plate 12, the sprocket 54 is rotated in the arrow mark direction P through chain 31 by the speed reducing unit 30. The casing 47 secured to the sprocket 54 is rotated therewith in the same direction so that the first and third bevel gears 49, 51 tend to be rotated by way of the pair of second bevel gears 50 carried by the casing 47. However, since the intermediate lever 26 is then locked against tilting under the urging of the tension spring 53, the first bevel gear 49 remains almost stationary. Thus, the first bevel gear 49 is not set into rotation and the rotation of the casing 47 is transmitted only to the third bevel gear 51 through the pair of second bevel gears 50.

Assuming that the numbers of teeth of the first and third bevel gears 49, 51 are $Z_{49}$ and $Z_{51}$ respectively and the numbers of revolutions of the first bevel gear 49, third bevel gear 51 and the casing 47 are $n_{49}$, $n_{51}$ and $n_{47}$, respectively, the following equation $$n_{51} = \left(1 + \frac{Z_{49}}{Z_{51}}\right) n_{47} - \frac{Z_{49}}{Z_{51}} n_{49}$$

may be obtained. Since $Z_{49}=Z_{51}$, the above equation may be rewritten as $n_{51}=2n_{47}-n_{49}$. Assuming that $n_{49}=0$, then $n_{51}=2n_{47}$ meaning that the third gear 51 is rotated in the same direction as and with twice the number of revolutions of the casing 47. Thus the shaft 44 and the pinion 45 are rotated in the arrow mark direction P for raising the squeegee posts 41 for a larger stroke distance.

Although only one second bevel gear 50 will do, preferably two bevel gears 50 are provided as in the above embodiment for realizing a balanced operation. Although the bevel gears 49, 50 and 51 are used as intersecting axis gears in the above embodiment, face gears or other intersecting axis gears may also be employed. Further, the cam disc 22 may be replaced by other cams. Although the bearings 48, 52 are used in the above embodiment for mounting the differential gear unit 46 on the shaft, the present invention is not limited to such specific mounting mode.

According to the squeegee pressing device of the present invention, as described above, a predetermined downward displacement is afforded to the squeegee posts 41 through differential displacement brought about by the cam 22 for pressing the squeegee 17 onto the screen plate 12. Thus, in distinction from the conventional device, it is not the force of the tension spring 32 but the displacement brought about by the cam 22 that affords the strong and positive pressure. Also the squeegee pressure may be easily adjustable by suitable selection of the cam profile and vertical adjustment of the mounting position of the squeegee 17. Moreover, the squeegee 17 is not subjected to impulsive oscillations at the start of pressing and thus there is no risk of producing undulating printing irregularities on the printed surface.

Moreover, by virtue of the provision of the differential gearing unit 46, even when the cam 22 is stationary for impeding forward and reverse rotation of the first intersecting axis gear 49, the second and third intersecting axis gears 50, 51 and the shaft 44 may be selectively rotated through rotation of casing 47 in disregard of such impeding operation, for raising the squeegee posts 41 over a larger stroke distance. Thus, according to the present invention, mounting or detaching the plate frame 13 for cleaning of the plate 12 may be facilitated.

It is apparent that various changes may be made without departing from the spirit and scope of the invention and hence the present invention is not limited to the specific embodiment except as defined by the appended claims.

What is claimed is:

1. In a screen printing machine of the type in which a screen plate is reciprocated to and fro and printing paper sheets are supplied to the lower surface zone of the screen plate in timing with forward travel of the screen plate and in which the screen plate is pressed by the squeegee for printing the paper sheets through the screen when the squeegee vertically movable within predetermined stroke distance is at the lowermost stroke position thereof, a device for pressing the squeegee for printing, comprising a support shaft rotatable in either directions, a first intersecting axis gear mounted on said support shaft and rotatable in either direction independently of the rotation of the support shaft and in timing with displacement brought about by a cam, a rotatable member rotatably carrying at least one second intersecting axis gear meshing with said first intersecting axis gear, said rotatable member being carried for rotation about said support shaft and independently of said support shaft, a third intersecting axis gear mounted on said support shaft for rotation in unison therewith and meshing with said second intersecting axis gears, a pair of pinions mounted on said support shaft for rotation in unison therewith, at least one squeegee post meshing with said pinions and vertically movable by being linked with forward and reverse rotation of the support shaft, said post carrying said squeegee at the upper end extremity thereof, and drive means for driving said rotatable member, said squeegee post being afforded a predetermined downward displacement through the medium of all of said intersecting axis gears and said support shaft by differential displacement brought about by said cam, for pressing said squeegee to said screen plate, said squeegee post being raised a larger distance by said drive means through the medium of said second and third intersecting axis gears and said support shaft when said first intersecting axis gear remains stationary, for lifting the squeegee above the screen plate.

2. A device for pressing the squeegee for printing as defined in claim 1 wherein a pair of pinions are secured to both end parts of said support shaft for meshing with a pair of squeegee posts positioned on either sides of a machine frame of the printing machine, the squeegee is carried by and between the upper extreme portions of said posts, a doctor is mounted at the back of said squeegee through a link device, said doctor being moved in the reverse direction to the squeegee movement by being linked with vertical motion of said squeegee, and being raised a larger stroke distance with said squeegee when the squeegee is raised a larger stroke distance.

3. A device for pressing the squeegee for printing as defined in claim 2 wherein said link device comprises a pair of upper and lower doctor reciprocating levers mounted vertically tiltably to the upper end parts of said squeegee posts and extending towards aft, a pair of doctor mounting blocks pivotally mounted to and between the upper and lower doctor reciprocating levers and extending vertically, said blocks carrying said doctor, and a pair of stopper pins pivotally mounted to said upper and lower doctor reciprocating levers between said blocks and the upper end parts of said posts and abutting at the respective lower end parts on said machine frame.

4. A device for pressing the squeegee for printing as defined in claim 1 wherein said first, second and third intersecting axis gears are first, second and third bevel gears, said first bevel gear is adapted to be rotated by said cam through a further link device, said rotatable member is a casing for enclosing said first, second and third bevel gears, said casing carrying rotatably said second bevel gear and a fourth bevel gear meshing in turn with said first and third bevel gears, and wherein said drive means comprise a sprocket secured to said rotatable member and rotatable about said support shaft, and a speed reducing unit interconnected to an electric motor, said unit being adapted for rotating said sprocket through a chain.

5. A device for pressing the squeegee for printing as defined in claim 4 wherein said cam is formed by a cam disc having a lesser radius of curvature portion and a larger radius of curvature portion and said further link device comprises an intermediate lever mounted on said support shaft and adapted to be rotated in unison with said first bevel gear and independently of rotation of said support shaft, and a cam lever operatively connected with said intermediate lever and positioned in the vicinity of said cam disc, said cam lever carrying a cam roller rotatably connected with the intermediate lever, said intermediate lever being urged at all times by the tensile force of a tension spring in a predetermined direction or in the direction to raise the squeegee through the medium of said support shaft and squeegee posts whereby the cam roller of the cam lever is urged at all times into abutting with the outer periphery of the cam.

6. A device for pressing the squeegee for printing as defined in claim 5 wherein the squeegee mounted to the upper end parts of the squeegee posts is adapted to be pressed onto the screen plate when the larger radius of curvature portion of the cam disc is engaged with the cam roller on the cam lever.

* * * * *